US011623159B2

(12) United States Patent
Zhilin

(10) Patent No.: US 11,623,159 B2
(45) Date of Patent: Apr. 11, 2023

(54) MUSICAL CONSTRUCTIVE MODULE AND CONSTRUCTOR

(71) Applicant: Oleg Vasilyevich Zhilin, Vladivostok (RU)

(72) Inventor: Oleg Vasilyevich Zhilin, Vladivostok (RU)

( * ) Notice: Subject to any disclaimer, the term of this patent is extended or adjusted under 35 U.S.C. 154(b) by 119 days.

(21) Appl. No.: 17/192,067

(22) Filed: Mar. 4, 2021

(65) Prior Publication Data

US 2022/0047959 A1 Feb. 17, 2022

(30) Foreign Application Priority Data

Aug. 12, 2020 (RU) ..... RU2020126939

(51) Int. Cl.

| | |
|---|---|
| ***A63H 33/10*** | (2006.01) |
| ***A63H 33/04*** | (2006.01) |
| ***G10D 13/08*** | (2020.01) |
| ***A63H 5/00*** | (2006.01) |

(52) U.S. Cl.

CPC ..... *A63H 33/042* (2013.01); *A63H 5/00* (2013.01); *A63H 33/10* (2013.01); *G10D 13/08* (2013.01)

(58) Field of Classification Search

CPC ..... A63H 5/00; A63H 33/10; A63H 33/105; A63H 33/108

See application file for complete search history.

(56) References Cited

U.S. PATENT DOCUMENTS

| | | | | |
|---|---|---|---|---|
| 2,132,647 | A * | 10/1938 | Robins | A63H 33/108 D21/500 |
| 2,849,832 | A * | 9/1958 | Jorgensen | A63H 33/105 403/345 |
| 5,545,070 | A * | 8/1996 | Liu | A63H 33/10 446/104 |
| 9,033,761 | B2 * | 5/2015 | Azmani | A63H 33/105 446/122 |
| 9,879,413 | B2 * | 1/2018 | Castelli | E04B 1/1903 |
| 2016/0030854 | A1 * | 2/2016 | Shaanti | A63H 33/086 446/85 |
| 2020/0230513 | A1 * | 7/2020 | Chao | A63H 33/107 |

* cited by examiner

*Primary Examiner* — John A Ricci

(74) *Attorney, Agent, or Firm* — Nadya Reingand

(57) ABSTRACT

The invention describes a new constructor module with the additive aspects of sound and dynamic construction. A base block is provided with varying mating elements for adjustably connecting structural blocks and plates together with sounding elements. A plurality of base blocks may be constructed based on desired output in various shapes and structures. The base blocks are coupled together with connecting elements and fixing pins, which also assist in coupling the sounding elements. Additional plates are also utilized for creating dynamic sounds and structures, including D-shaped plates and U-shaped plates. Constructor set modules may utilize all such elements in a plurality of structures, or at minimum, only base blocks, connecting elements, a sounding element, and fixing pins.

19 Claims, 9 Drawing Sheets

MUSICAL CONSTRUCTIVE MODULE AND CONSTRUCTOR

CROSS-REFERENCE To RELATED APPLICATIONS

The present patent application claims priority to Russian Patent Application Ser. No. 2020126939, filed Aug. 12, 2020 said application and its disclosures being incorporated herein by reference in their entireties.

FIELD OF THE INVENTION

This invention relates to the field of educational toys, namely to constructor sets equipped with elements for producing sound.

BACKGROUND ART

A learning toy is known (CN209828274—EDUCATIONAL BUILDING BLOCK JOINTED BOARD TOY, filing date Apr. 11, 2019, publication number 209828274, publication date Dec. 24, 2019). This utility model contains H-shaped connectors and wood blocks, the bottom and all side faces of the block being provided with two mutually symmetrical insertion holes. Two mutually symmetrical inserted cylindrical protrusions are located on the upper surface of the block. Two symmetrical rectangular slots are formed on the two parallel side surfaces of the block. H-connector fastens a pair of adjacent wooden blocks located in the same horizontal plane.

A disadvantage of the utility model is that it is not possible to create toys in three mutually perpendicular planes by shifting the blocks.

A musical play kit is known (WO2001052959—MUSIC TOY KIT, international filing date 10 Aug. 2000, publication number WO/2001/052959, publication date 26 Jul. 2001), containing a body and a set of building toy blocks, stored in it. The device is provided with connecting elements similar or compatible with elements of building toy blocks containing a set of keys corresponding to different notes, and each of the keys is provided with a means of identification and is connected to a sound generator built into the device body to produce a corresponding sound when the key on the lid of the block is pressed.

The disadvantage of the known solution is that it is not possible to create a constructor in three mutually perpendicular planes (in this solution, only in the form of a piano or a drum) because of the uniformity of the parts and the possibility of fixing only in one plane, the presence of a sound generator, as well as playback of a limited number of tunes.

A musical constructor is known (US20160030854 CONSTRUCTIVE MUSIC, filing date 22 Aug. 2014, publication number 20160030854, publication date 4 Feb. 2016), consisting of a set of base blocks provided with means for attaching to another similar base block. The base blocks are made of four walls and two covers. The base blocks are provided with means for mounting various musical instruments, including elements of a xylophone (musical instrument).

The disadvantages of this invention should include:

due to the uniformity of parts and the possibility of fixing only in one plane and the multiplicity of the interval of movement of the base block relative to each other, it is not possible to create designs of large musical models and, accordingly, the sounding of only short melodies;

to play a melody on this constructor requires a large number of base blocks at a smaller number of sounding plates of different sizes;

The assembled base blocks of the construction set are not held together securely;

a small range of parts of the constructor, which does not allow you to create the possibility of connecting them in different ways depending on the required task of building models and creating melodies, because the parts cannot be attached on all sides.

the design of the base blocks is made in such a way that they can be used for assembly only in the specified constructor.

The known technical solution is the closest to the claimed invention and is taken as a prototype.

SUMMARY OF THE INVENTION

The invention provides a compact musical construction set, with a wide range of parts of different configurations, providing the possibility of joining them in different manners depending on the task required—from simple products, consisting of a minimum number of parts, to three-dimensional structures, while ensuring a reliable holding of the assembled base blocks of the construction set together, including the construction of large models. Each resulting construction must contain a set of sounding bodies capable of playing back at least one melody. Besides, the constructor base blocks should have such a construction, which allows combining them with the base blocks of other commonly known constructors, such as Lego constructor base blocks.

The task set is solved by the fact that the music constructor is made in the form of an at least partially hollow three-dimensional structure comprising one or more base blocks having mutually perpendicular sides, the one or more base blocks being provided with varying types of connectors and protrusions for connecting various plates or connecting structures. The base block is made with the possibility of connecting via mating surfaces with mating elements of mating pieces by means of connecting means and fixing elements. On one of the longitudinal walls of the base block (e.g., the upper wall of the base block) along its longitudinal axis, an indentation is provided, in which connecting means are adjustably installed with the possibility of their movement within the indentation and thereby along the longitudinal axis of the base block. The connecting means allow for sounding bodies to be installed along the indentation, and fixing elements are provided to fix the sounding body to a given indentation. At least one of the longitudinal walls of the base block other than the wall with the indentation has at least one longitudinal groove along the entire length of this wall. An acoustic hole is made in the center of each transverse wall of the base blocks. Each connecting means is made in the form of a stud, the stud having a pair of cylindrical protrusions located equidistant from its axis in an upper portion of the stud, an axial hole, and a bottom portion having a tapered end for fixing the stud in the indentation of the base block.

In some aspects, on the longitudinal wall of the base block opposite the longitudinal wall having the indentation, there are two rectangularly shaped longitudinal grooves positioned symmetrically to the longitudinal axis of the base block, for the entire length of that wall of the base block.

Alternatively, on the longitudinal wall of the base block opposite the indentation, there are two longitudinal connection slots located symmetrically about the longitudinal axis for the entire length of this wall, and on the other two longitudinal walls of the base block on their longitudinal axes there is one U-shaped longitudinal connection slots on each wall of the base block for the entire length of the base block wall.

Alternatively, on the longitudinal wall of the base block opposite the indentation, there are two longitudinal connecting slots symmetrically to the longitudinal axis for the entire length of the base block wall, and on the other two longitudinal walls of the base block symmetrically to the longitudinal axis there are two rectangular longitudinal connecting slots on each wall of the base block for the entire length of the base block wall.

The musical construction set may be additionally equipped with connecting D-shaped plates, of which the outer side walls comprise guides to create a spatial configuration of the constructor model for fitting U-shaped plates, which have matching inner grooves on inner portions of the U-shaped plate. Both D-shaped and U-shaped plates may also be positioned in connection with cylindrical protrusions located on either connecting means or the upper portions of U-shaped plates. Varying constructions of base blocks with D-shaped and/or U-shaped plates result in varying potential structures and sounds produced.

In some aspects, the sounding body is made in the form of a plate, in which there are holes for fastening.

In some aspects, the sounding body is made in the form of a hollow cylinder.

In some aspects, the fixing elements are made in the form of a T-shaped stud, the upper part of which comprises a pair of cylindrical protrusions located equidistant from the axis of the stud, and a lower part which is made with a taper to the base.

In some aspects, the fixing element for a sounding body comprising a plate is made in the form of a stud with a cylindrical protrusion in its upper part.

In some aspects, the fixing element for a sounding body in the form of a cylinder is a stud with a hollow cylinder placed in its upper part, the inner diameter of which corresponds to the outer diameter of the sounding body.

In some aspects, on one of the end-faces of the D-shaped plate, in its center, there is a projection of a rectangular section for connection with a mating opposite end of another D-shaped plate.

In some aspects, the musical constructor is further provided with a base plate having rectangular recesses for connecting base blocks onto the base plate.

In some aspects, the musical constructor is additionally equipped with a note duration marker, made in the form of a rod with a cylindrical head, on the front side of which is printed information about the duration of the note.

In some aspects, the musical constructor is additionally equipped with a duration marker made in the form of an oval plate with a circular hole, the diameter of which corresponds to the diameter of the note duration marker rod, on the front side of which information about the duration of the interval between the notes is printed.

In some aspects, the musical constructor is additionally equipped with a magnetic board, made in the form of a metal staple, as well as magnetic letters, numbers, and a marker.

In some aspects, the musical constructor is additionally equipped with drumsticks made of plastic or wood with percussion spherical tips.

BRIEF DESCRIPTION OF THE DRAWINGS

The present invention will now be discussed in further detail below with reference to the accompanying figures in which:

FIG. 1A shows a basic base block without side grooves. FIG. 1B shows a second type of base block having rectangular side grooves. FIG. 1C shows a third type of base block having L-shaped side grooves.

FIG. 20B is a cross-sectional view of the general view provided in FIG. 20A.

FIG. 21B is a cross-sectional view of the general view provided in FIG. 21A.

FIG. 22 shows the constructor in the form of a ring, assembled from base blocks, D-shaped plates, sounding bodies, and fixing elements.

FIG. 23B is an exploded view of the general view provided in FIG. 23A.

DETAILED DESCRIPTION OF THE PREFERRED EMBODIMENTS

Figure 1A:
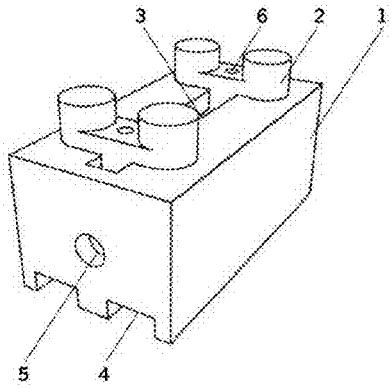
FIGS. 1A-1C show general views of the base blocks of the musical constructor set, each base block being connected to two connecting means.

In the following description, for purposes of explanation, specific examples are set forth to provide a thorough understanding of the present invention. However, it will be apparent to one skilled in the art that these specific details are not required in order to practice the present invention. The same techniques can easily be applied to other types of similar systems.

The present invention has the following essential distinguishing features:

On one of the longitudinal walls of the base block 1, e.g., an upper wall, along its longitudinal axis, an indentation (i.e., a slot) 3 is made in which connecting means 2 are mounted with a possibility of their movement (i.e., adjustably) within the indentation 3;

at least one longitudinal wall of the base block 1 other than the wall with the indentation 3 has at least one longitudinal groove 4 along the entire length of this wall;

in the center of each transverse wall of the base block 1, an acoustic hole 5 is provided;

each connecting means 2 is made in the form of a stud with an upper part 29, axis 30, and lower part 31, the upper part which comprises a paired cylindrical protrusion 27, wherein the two cylinders 28 making up the pair are positioned equidistant from the axis 30 of the stud, and on the axis 30 itself there is a hole 6, the lower part 31 of the stud comprising a shaft, the shaft being tapered for fixing the stud in an indentation 3.

the three-dimensional base blocks 1 are non-dismountable (i.e., solid) polyhedrons having varying configurations, the outer walls/surfaces of which further comprise side grooves (rectangular grooves 25 or L-shaped grooves 26), the side grooves providing a fastening location for connecting U-shaped or D-shaped plates;

additional connecting D-shaped plates 8, either on top/bottom of base blocks or on the lateral walls of the base block via a connection between the various grooves of the base block and a mating groove 32 on a bottom face of the D-shaped plate;

additional connecting U-shaped plates 10, which have inner grooves 11 on the inner parts of parallel walls, with single cylindrical protrusions 12 in the center of their upper surface, and with through holes 13 along the vertical axial line to fix U-shaped plates; and fixing elements of varying types for attaching one or more sounding bodies to the base block, to produce varying melodies.

This combination of common and distinctive essential features provides a technical result unavailable in the prior art. It is this combination of essential features of the claimed musical constructor module, containing a set of these elements, which performs the following functional tasks to achieve the required technical result:

compactness is provided in the claimed invention by the fact that the number of placed sounding bodies does not depend on the number and size of base blocks;

reliable holding assembled base blocks of the constructor together, including for constructions of large models, due to the large assortment of parts of different configuration (base blocks with different numbers of grooves, U-shaped plates, and D-shaped plates);

to assemble different constructions by volume and to play long melodies on them, thanks to the execution of the connecting elements with the possibility to move in the base block aperture, which allows you to perform fixing on all sides of the construction set;

to transform one model into another, using repeatedly an unlimited number of times.

The present invention promotes creativity and imagination in consumers, allowing the user to create various musical constructions, such as a musical Christmas tree, and compose music with its own original sounds.

On the basis of the stated above it is possible to conclude, that the set of essential distinctive features of the claimed devices has a causal relationship with the achieved technical result. Therefore, the claimed devices are new, inventive, and usable.

Figure 2:
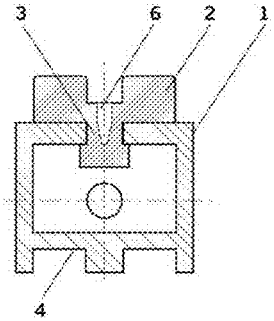
FIG. 2 shows a cross sectional view of a base block (without side grooves) according to the present invention.
Figure 3:
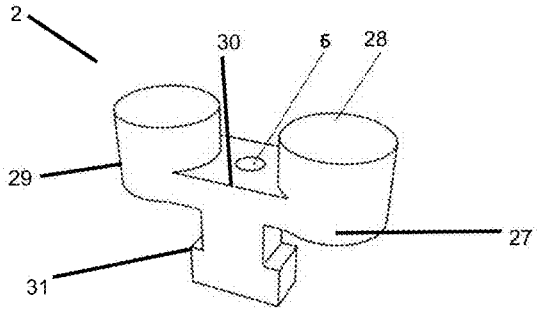
FIG. 3 shows a first type of connecting means for insertion into an indentation.

The drawings use the following symbols. The base block 1 (FIG. 1) is made in the form of a three-dimensional block of rectangular cross section with mutually perpendicular sides, with the possibility of conjugate surfaces with mating elements of conjugate base blocks via connecting means 2. The base block 1 is provided with two connecting means 2 in FIG. 1. On one of the longitudinal walls (typically an upper wall) of the base block 1, along its longitudinal axis, an indentation 3 is made, in which the connecting means 2 may be adjustably installed, with the possibility of their movement along the indentation 3. On the longitudinal wall of the base block opposite the longitudinal wall having the indentation 3, there are two longitudinal grooves 4 along the full length of the base block wall (see FIGS. 1-2). The size of each groove 4 is made such that an upper portion of the connecting means 2 may be placed within them. In the center of each transverse wall of the base block 1, an acoustic hole 5 is made. Each connecting means 2 is made in the form of a stud, the stud having an upper part, an axis, and a lower part (see FIG. 3). In the upper part, a paired cylindrical protrusion extends out from the stud's axis, a hole 6 is made in the very axis of the stud, and the lower part of the stud is a tapered shaft designed for adjustably fixing the stud in the indentation 3.

Figure 1B:
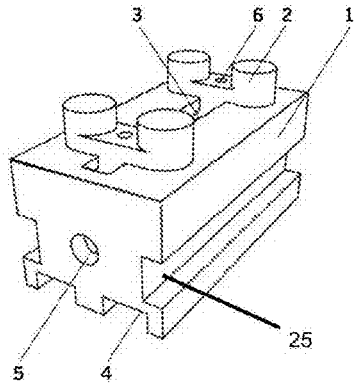

Optionally, as shown in FIG. 1B, on the other two longitudinal walls of the base block 1, on their longitudinal axes, one side groove is made on each such wall of the base block 1 for the entire length of the wall, each of the one side grooves being a rectangular groove 25.

Figure 1C:
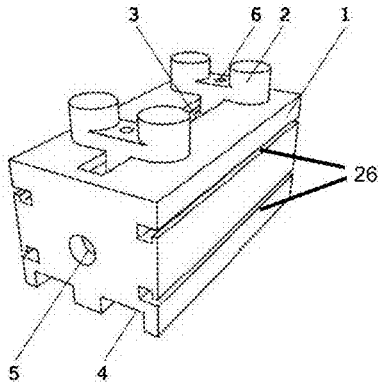

Alternatively, as shown in FIG. 1C, on the other two longitudinal walls of the base block 1, there are two side grooves, each of the two side grooves being an L-shaped groove 26.

The dimensions of the optional/additional side grooves of the base block are identical to the dimensions of the inner grooves 11 located on the inside of the parallel walls of U-shaped plates 10 and/or the varying cylindrical protrusions discussed herein.

Figure 4:
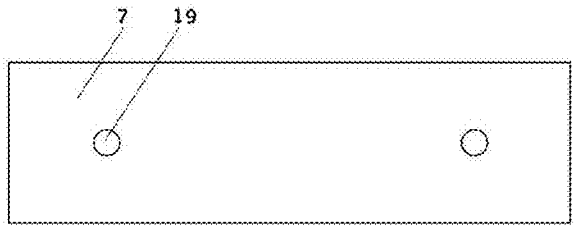
FIG. 4 shows a first type of sounding body, made in the form of a plate.
Figure 5:
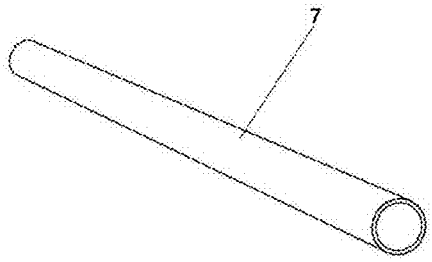
FIG. 5 shows a second type of sounding body, made in the form of a hollow cylinder.
Figure 11:
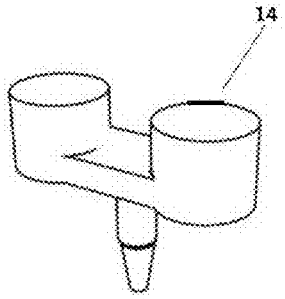
FIG. 11 shows a first type of fixing element according to the present invention, comprising a paired cylindrical protrusion in its upper part.

The musical constructor, in one embodiment, thus comprises a set of base blocks 1, each base block 1 comprising a three-dimensional (3D) and at least partially hollow block, the constructor further comprising connecting means 2, each base block 1 further comprising an indentation 3, wherein one or more sounding bodies 7, either in the form of a plate (see FIG. 4) or in the form of a hollow cylinder (see FIG. 5) are coupled to the base block 1 via the connecting means 2 and a fixing element 14, 15, or 16. The sounding bodies 7 can be made of metal, plastic, wood, or other sound-producing material. Each sounding body 7 is fixed by a fixing element 14 (see FIG. 11) or 15 (see FIG. 12) or 16 (see FIG. 13). In the case of a hollow cylinder sounding body, the sounding body is fixed by a fixing element comprising an upper part having a cylindrical opening for receiving the sounding body 16 (see FIG. 13).

Figure 6:
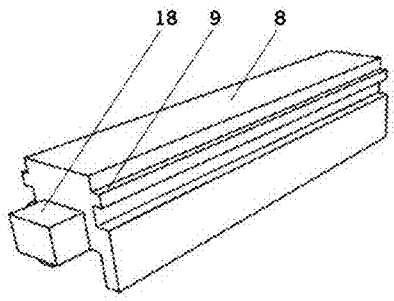
FIG. 6 shows a D-shaped (i.e., Cyrillic De-shaped) plate according to the present invention.
Figure 7:
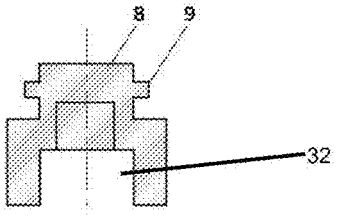
FIG. 7 shows a cross-sectional view of a D-shaped plate.
Figure 8:
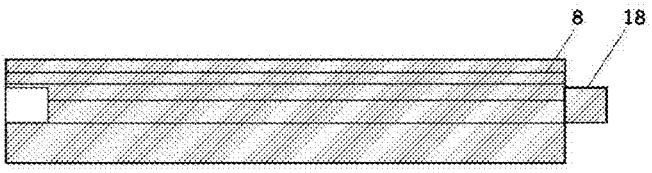
FIG. 8 shows a longitudinal cross section of a D-shaped plate.
Figure 9:
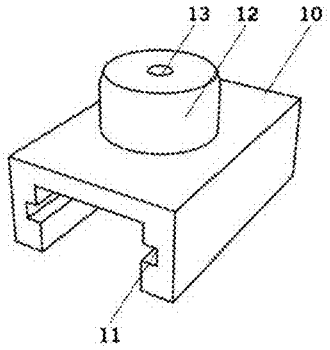
FIG. 9 shows a U-shaped plate according to the present invention.
Figure 10:
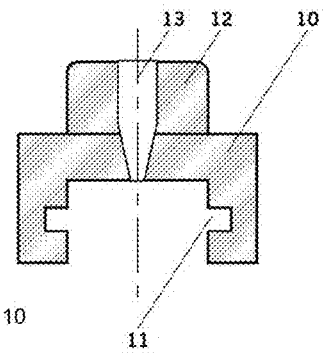
FIG. 10 shows a U-shaped plate in a cross-sectional view.

The module is built by connecting base blocks 1 using connecting means 2 and fixing elements 14, 15, or 16, and optionally further connecting D-shaped plates 8 (FIGS. 6, 7, 8) and/or U-shaped plates 10, while also including sounding bodies 7 via fixing elements 14, 15, or 16. Outer sides of the D-shaped plates further comprise longitudinal guides 9 to create a spatial configuration for matching U-shaped plates 10 (see FIGS. 9, 10) which comprise mating inner grooves 11 located on the inner part of parallel walls of the U-shaped plates 10. At the end of the D-shaped plate is a rectangular protrusion 18, which further serves to connect the D-shaped plates to each other. Each U-shaped plate (see FIG. 9, FIG. 10) comprises a single cylindrical protrusion 12 located in the center of its upper surface, with through holes 13 along the vertical axial line of the single cylindrical protrusion 12, the through holes 13 being utilized for coupling with the fixing elements 14, 15, or 16. The single cylindrical protrusion 12 may also be mated directly with a bottom portion of a D-shaped plate. The inner grooves 11 further allow for the U-shaped plate 10 to be mounted on a D-shaped plate 8 by means of D-plate guides 9. The U-shaped plate 10 can further move longitudinally, after being fixed, either along the D-plate guides 9 or along longitudinal grooves 4 of the base block 1. In this case, the dimensions of the longitudinal grooves 4 should be identical to the dimensions of the inner grooves 11.

The module is provided with fixing elements 14 (FIG. 11), made in the form of a T-shaped stud, having an upper part comprising a pair of cylindrical projections (see FIG. 11) which are located equidistant from the axis of the stud, and a lower part which is made with a taper to its base. The pair of cylindrical projections of the fixing element 14 are mated with the longitudinal grooves 4. The U-shaped plate 10 can also be mounted on the pair of cylindrical projections.

Figure 12:
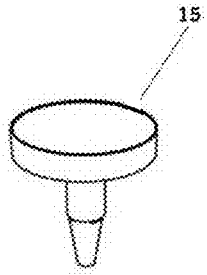
FIG. 12 shows a secondary fixing element according to the present invention, comprising a stud with a cylindrical cap in its upper part.
Figure 13:
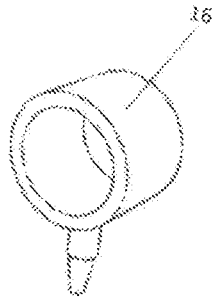
FIG. 13 shows a tertiary fixing element according to the present invention, comprising a stud with a hollow cylinder in its upper part.

The module may further be provided with secondary fixing elements 15 for fixing sounding bodies 7 in the form of a plate (FIG. 12), as well as tertiary fixing elements 16 for fixing sounding bodies 7 in the form of a hollow cylinder (FIG. 13), for creating varying sounds. In the case of a sounding body 7 in the form of a plate, the sounding plate comprises holes 19 for the secondary fixing elements 15. Secondary fixing element 15 is made in the form of a stud with a T-shaped cross-section in its upper part (FIG. 12). The tertiary fixing element 16 is made in the form of a stud with a hollow cylinder placed in its upper part, the inner diameter of which corresponds to the outer diameter of the sounding body 7 made in the form of a hollow cylinder (FIG. 13), which is placed within the hollow cylinder.

The base block 1 may additionally be equipped with a marker for the duration of a note, made in the form of a rod with a cylindrical head on the front side of which is printed information about the duration of the note (not shown in the Drawings).

The base block may additionally be equipped with a note duration marker, made in the form of an oval plate with a circular hole, the diameter of which corresponds to the diameter of the note duration marker rod, on the front part of which information about the duration of the interval between the notes is provided (not shown in the Drawings).

The base block may additionally be equipped with a magnetic board, made in the form of a metal staple, as well as magnetic letters, numbers, and/or a marker (not shown in the Drawings).

The base block may additionally be equipped with drumsticks or other percussive rods, made of plastic or wood and comprising percussion spherical tips (not shown in the Drawings).

Such a performance of the musical constructor base blocks, provides the ability to connect different options, depending on the task required to build models. Thus, the relative simplicity of connecting the mating base blocks (FIG. 1) and fixing the sounding bodies 7 to the base blocks provides a transition from assembling a simple structure, such as a square, to a more complex construction. Many connected elements comprising both first and U-shaped plates allows to significantly expand the assembly of various structures. At the same time, despite the range of parts of different configurations, the musical constructor provides a simple assembly and disconnection mechanism with a reliable retention of assembled base blocks and sounding bodies of the constructor together, including for large constructions and obtaining long melodies.

FIG. 14-19 exemplify various embodiments for connecting elements of the musical constructor according to the present invention.

Figure 14:
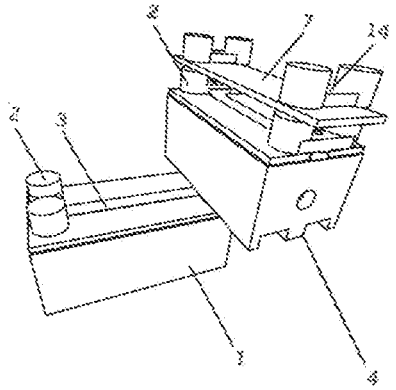
FIG. 14 shows an example of an assembly of two base blocks, one sounding body, connecting means, and first type fixing elements.

FIG. 14 shows the assembly of two base blocks 1 utilizing connecting means 2, wherein a sounding body 7 is coupled to the base block 1 using fixing elements 14. One of the connecting elements 2 coupled to the lower base block 1 is set perpendicular to the orientation of the visible connecting element 2 of the lower base block 1. The upper base block is connected to the upper portion (i.e., the pair of cylindrical protrusions) of the connecting means installed in the indentation 3 of the lower base block, via the longitudinal grooves 4. The sounding body 7 is placed on the connecting means 2 of the upper block so that its holes coincide with the bottom portion (i.e., shaft) of the fixing element 14.

Figure 15:
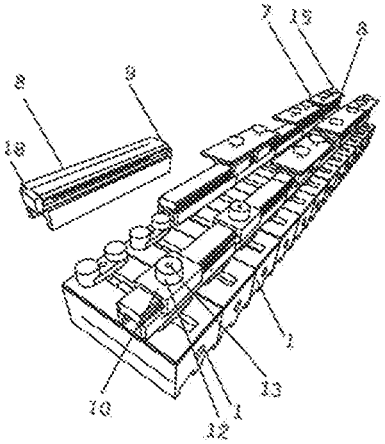
FIG. 15 shows an example of an assembly of base blocks, D-shaped plates, U-shaped plates, sounding plates, connecting means, and first type and secondary fixing elements.

FIG. 15 shows an assembly of base blocks 1, D-shaped plates 8, U-shaped plates 10, sounding bodies 7 in the form of plates, connecting means 2, and secondary fixing elements 15. Base blocks 1 are installed parallel to each other by their longitudinal sides. On the upper side of each base block 1, on top of adjustably installed connecting means 2, D-shaped plates 8 are installed. Ends of D-shaped plates also lock via a rectangular protrusion 18 and a mating portion of an opposite end of a neighboring D-shaped plate. On the D-plate guide 9 of each D-shaped plate 8, the U-shaped plates 10 are fixed via the inner grooves 11 of the U-shaped plate mating the D-plate guides. The single cylindrical protrusion 12 of each U-shaped plate 10 receives a fixing element 15, and between the fixing element 15 and the single cylindrical protrusion 12, a sounding body 7 is mounted via its hole 19.

Figure 16:
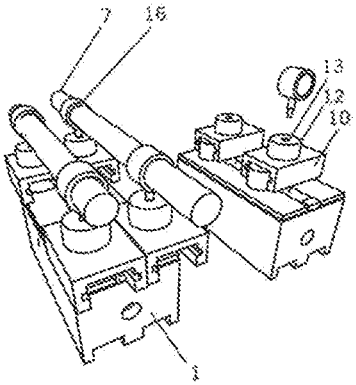
FIG. 16 shows an example of an assembly of base blocks, U-shaped plates, sounding cylinders, connecting means, and first type and tertiary fixing elements.

FIG. 16 shows an example of the musical constructor assembly comprising base blocks 1, U-shaped plates 10, sounding bodies 7 in the form of hollow cylinders, connecting means 2, and tertiary fixing elements 16. The U-shaped plates 10 are installed on the connecting elements 2 on the base block 1. Tertiary fixing elements 16 are installed in the axial hole 13 of the single cylindrical protrusion 12 of the U-shaped plates 10. The sounding body 7, made in the form of a hollow cylinder, is installed in the tertiary fixing element 16.

Figure 17:
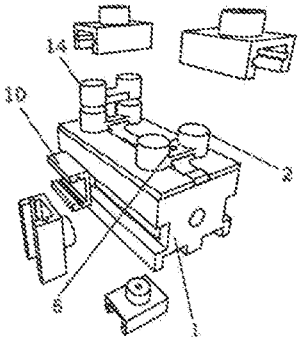
FIG. 17 shows an example of an assembly of U-shaped plates connected to a base block via a clamping/mating mechanism.
Figure 18A:
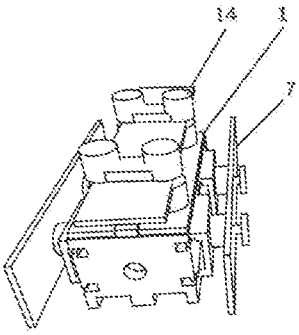
FIGS. 18A-18D shows an example of an assembly of a base block equipped with sounding bodies on more than one side/wall of the base block. 4 views are provided from varying angles via FIGS. 18A through 18D.
Figure 18B:
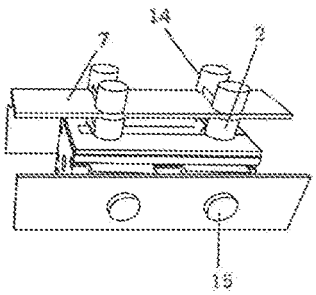
Figure 18C:
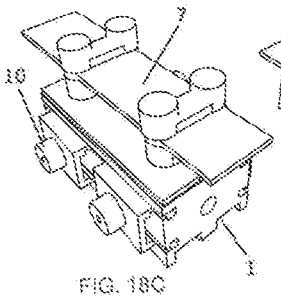
Figure 18D:
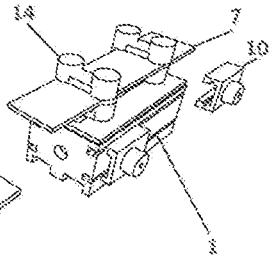
Figure 19A:
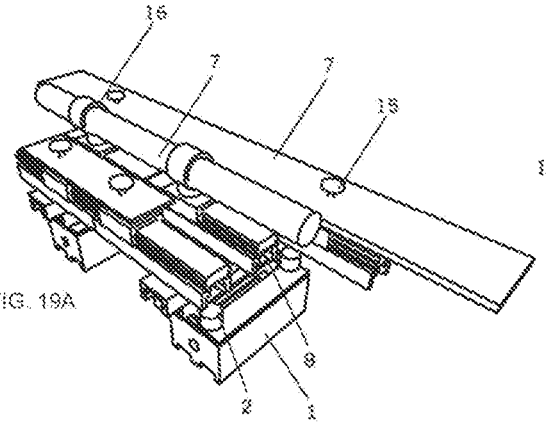
FIGS. 19A-19B show further examples of an assembly of base blocks with various elements according to the present invention.
Figure 19B:
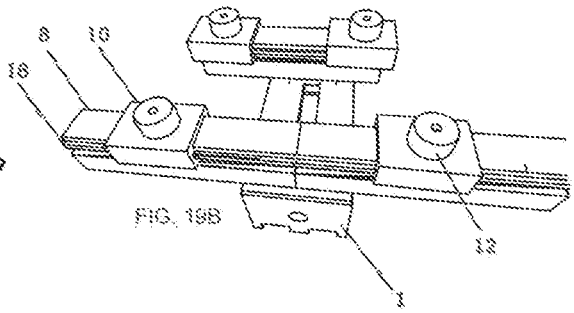

FIG. 17 shows an assembly comprising base blocks 1, U-shaped plates 10, connecting means 2, and fixing elements 14. The U-shaped plate 10 can be attached to the base block in a variety of manners: (1) to the connecting means 2 on the base block 1, either parallel or perpendicular to the surface of the base block 1; (2) to the connecting means 2 of the base block 1, both parallel and perpendicular to the surface of the base block 1 by means of the fixing element 14, wherein one U-shaped plate is rotated relative to the other; (3) in the side grooves of the base block 1 via its single cylindrical protrusion 12 mating with the dimensions of the side groove of the base block 1.

As an illustration of the assortment of parts assembly, examples of detailing of polyhedrons of different configurations of the set of base blocks of the constructor and its elements, FIGS. 18A-18D and 19A-19B are presented.

FIGS. 20-24 explain the examples of assembled from the musical constructor designs.

Figure 20A:
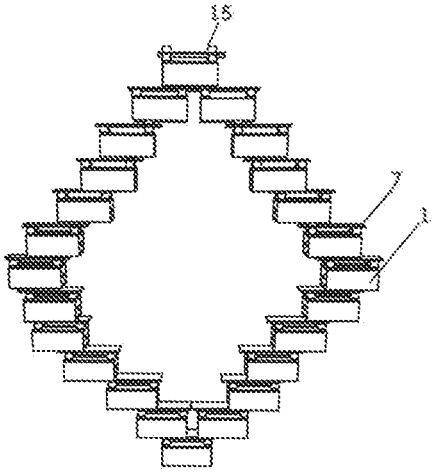
FIGS. 20A-20B show another example of a musical constructor according to the present invention.
Figure 20B:
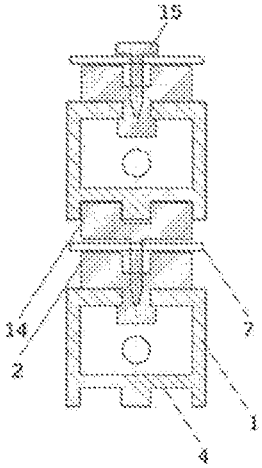

FIGS. 20A-20B show a complex rhombus-shaped model with base blocks 1 with sounding bodies 7 of rectangular shape. In this design, each base block 1 is provided with a sounding body 7 fixed with a secondary fixing element 15. Via mating longitudinal grooves 4 of the base blocks 1 with the paired cylindrical protrusions of fixing elements 14, it is possible to install the base blocks 1 provided with sounding bodies 7 on each other while maintaining the possibility of extracting sounds.

Figure 21A:
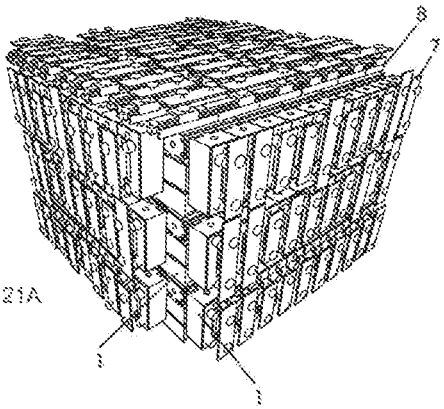
FIGS. 21A-21B show another example of a musical constructor according to the present invention.
Figure 21B:
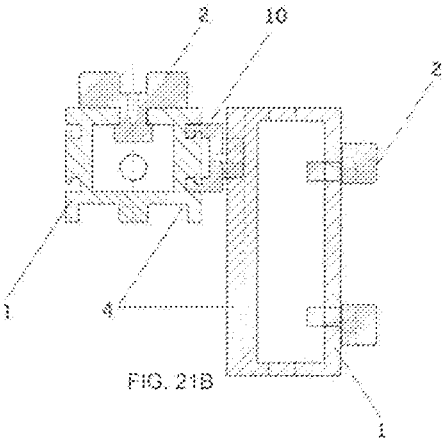

FIGS. 21A-21B show a model of a complex shape in the form of a cube with a possibility of fixation of sounding bodies 7 from different sides. This possibility is due to the use of rows of base blocks 1 installed via a U-shaped plate 10 coupled to a side groove of a base block 1, the rows of base blocks 1 being installed on the U-shaped plate's single cylindrical protrusion via its longitudinal grooves 4. On the U-shaped plates 10, the base blocks 1 are placed in a perpendicular plane, forming a surface suitable for fixation of sounding bodies 7 or other base blocks 1.

Figure 22:
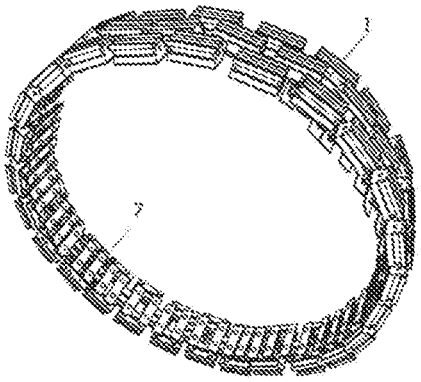
FIG. 22 shows another example of a musical constructor according to the present invention.

FIG. 22 shows a model of a complex ring-shaped structure assembled from base blocks 1, D-shaped plates 8, sounding bodies 7, and fixing elements. The model is collected from the base blocks 1 in three rows in a staggered order.

Figure 23A:
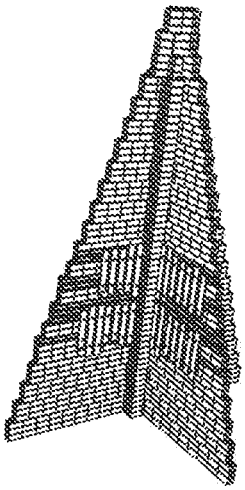
FIGS. 23A-23B show another example of a musical constructor according to the present invention, in the form of a tree.
Figure 23B:
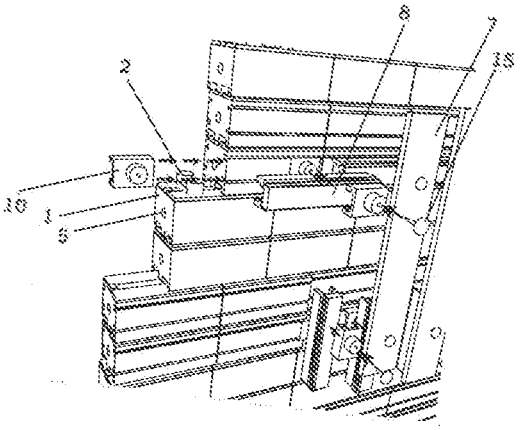

FIGS. 23A-23B shows a model of a complex structure in the form of a Christmas tree, assembled from base blocks 1, D-shaped plates 8, U-shaped plates 10, sounding bodies 7, and secondary fixing elements 15. Base blocks 1 are connected through the connecting means 2 in the vertical and horizontal planes. Due to the mobility of the connecting means 2, an offset is made between the rows of connecting elements 2 to create a Christmas tree image. Then in the longitudinal slots 4 base blocks 1 set the U-shaped plates 10, on the cylindrical ledges 12 which are set vertically or horizontally D-shaped plates, depending on the design of the model and its dimensions. Then the U-shaped plates 10 are installed on the D-plate guide 9 of the D-shaped plates. Sounding bodies 7 in the form of plates are mounted on the U-shaped plates 10. Then, in the hole of the single cylindrical protrusion of the U-shaped plates 10, secondary fixing elements 15 for fixation of the sounding body 7 are installed.

Figure 24:
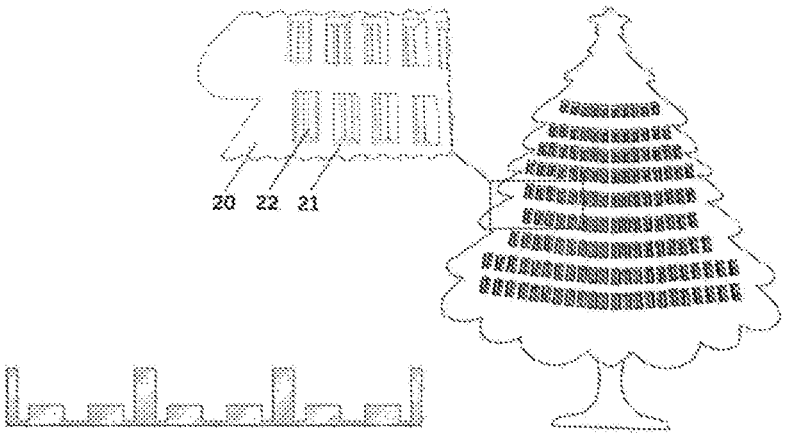
FIG. 24 shows an example of placing elements of the musical constructor according to the present invention on a tree.
Figure 25:
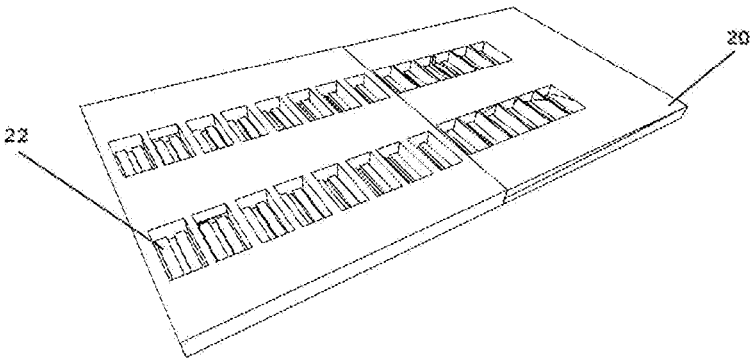
FIG. 25 shows an example of placing elements of the musical constructor on the base in the form of a book.

FIGS. 24-25 show further examples of fixing elements of the musical construction set on the base 20, made in the form of a plate with rectangular recesses 21, the size of which corresponds to the external dimensions of the base blocks 1. In the recesses 21 of the base 20, parallel to the longitudinal walls of the base block 1, there are mirrored protrusions 22 for the entire length of the surface of the base 20. These mirrored protrusions are mated with longitudinal grooves 4 of base blocks 1. The base can be made in any decorative form and of any hard material: cardboard, plastic, wood, and others. The base 20 is a base for placing the base blocks 1 with the sounding bodies 7 to create a rigidly fixed in one plane musical constructor. FIG. 24 shows the base in the form of a Christmas tree. FIG. 25 shows the base in the form of a book.

The proposed invention provides a technical result, which is the creation of a musical, compact constructor with a large range of parts of different configurations, providing a reliable retention of the assembled base blocks of the constructor together, including designs for large models. In the claimed invention, the number of placed sounding bodies does not depend on the number and size of base blocks, thus, an opportunity to create various musical constructions with different melodies is provided due to the use of different sized sounding bodies in the form of plates and cylinders.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A musical constructor module, comprising:

a base block with mutually perpendicular sides, wherein one of four longitudinal walls of the base block, along its longitudinal axis, comprises an indentation, one or more connecting means adjustably installed within the indentation, and a sounding body coupled to the base block via the one or more connecting means, the sounding body being fixed via a fixing element, wherein said sounding body is a plate comprising one or more holes.

2. The module of claim 1, wherein at least one other longitudinal wall of the base block comprises two L-shaped grooves.

3. The module of claim 1, wherein at least one other longitudinal wall of the base block comprises at least one rectangular groove.

4. The module of claim 1, wherein a center of each transverse wall of the base block comprises an acoustic hole.

5. The module of claim 1, wherein each connecting means comprises:

a stud having an upper part, an axis, and a bottom part, wherein:

the upper part comprises a paired cylindrical protrusion, each cylinder of the paired cylindrical protrusion being equidistant from the axis, the axis comprises a hole, and the bottom part is tapered.

6. The module of claim 1, wherein said sounding body is a cylinder, and wherein said fixing element comprises an upper part having a cylindrical opening for receiving the sounding body.

7. The module of claim 1, wherein said fixing element comprises a T-shaped stud.

8. The module of claim 1, wherein said fixing element comprises an upper part having a paired cylindrical protrusion.

9. The module of claim 8, further comprising:

a second base block connected to the upper part of the fixing element via a mating between the paired cylindrical protrusion of the fixing element and longitudinal grooves of the second base block, one or more second connecting means adjustably installed within an indentation of the second base block, and a second sounding body coupled to the one or more second connecting means, the second sounding body being fixed to the one or more second connecting means, and thereby the second base block, via a second fixing element.

10. The module of claim 1, further comprising a U-shaped plate adjustably connected to the module via inner grooves of the U-shaped plate.

11. The module of claim 10, the U-shaped plate further comprising a single cylindrical protrusion in its upper part.

12. The module of claim 1, further comprising a D-shaped plate connected to the module via a mating groove of the D-shaped plate.

13. The module of claim 12, wherein the D-shaped plate further comprises longitudinal guides, the longitudinal guides connecting one or more U-shaped plates to the module.

14. The module of claim 13, further comprising a second sounding body fixed by a second fixing element to the one or more U-shaped plates.

15. The module of claim 9, wherein the first sounding body is a plate and the second sounding body is a cylinder.

16. The module of claim 9, wherein the first and second base blocks are positioned parallel to one another.

17. The module of claim 9, wherein the first and second base blocks are positioned perpendicular to one another.

18. The module of claim 1, comprising at least two sounding bodies, the at least two sounding bodies being located on distinct faces of the base block.

19. The module of claim 1, wherein the base block is a solid polyhedron.

* * * * *